US006997727B1

(12) United States Patent
Legrady et al.

(10) Patent No.: US 6,997,727 B1
(45) Date of Patent: Feb. 14, 2006

(54) COMPLIANT SURFACE MOUNT ELECTRICAL CONTACTS FOR CIRCUIT BOARDS AND METHOD OF MAKING AND USING SAME

(75) Inventors: Janos Legrady, Putnam Valley, NY (US); William L. Woods, Kaufman, TX (US); Clifton L. Lindsey, Rockwall, TX (US); Thang D. Truong, Grand Prairie, TX (US); Jon P. Martin, Rockwall, TX (US); Richard D. Lytle, Plano, TX (US)

(73) Assignee: Zierick Manufacturing Corp, Mt. Kisco, NY (US)

( * ) Notice: Subject to any disclaimer, the term of this patent is extended or adjusted under 35 U.S.C. 154(b) by 0 days.

(21) Appl. No.: 10/388,570

(22) Filed: Mar. 14, 2003

(51) Int. Cl.
*H01R 13/64* (2006.01)

(52) U.S. Cl. ..... 439/246; 439/83; 439/885; 439/874

(58) Field of Classification Search ..... 439/246, 439/78–83, 885, 874–876
See application file for complete search history.

(56) References Cited

U.S. PATENT DOCUMENTS 5,122,066 A * 6/1992 Plossmer ..... 439/78
5,452,512 A * 9/1995 Foley et al. ..... 29/874
5,730,608 A * 3/1998 Legrady ..... 439/78
6,325,682 B1 * 12/2001 Seidler ..... 439/876
6,511,336 B1 * 1/2003 Turek et al. ..... 439/249
6,565,392 B1 * 5/2003 Padro ..... 439/751
6,572,397 B1 * 6/2003 Ju ..... 439/342

* cited by examiner

*Primary Examiner*—Truc Nguyen
(74) *Attorney, Agent, or Firm*—Myron Greenspan, Esq.; Lackenbach Siegel, LLP

(57) ABSTRACT

There is provided electrical contact for circuit boards. Each leg of the pin section has a deformable segment that can expand or contract along the direction of the leg to alleviate stress created by relative movement of printed circuit boards and/or off-board components interconnected thereby. The deformable segments have members that project in opposing directions relative to the direction of the leg, so that the segments are symmetrical. In one embodiment, each leg has a deformable segment having a outwardly curved shape. In another embodiment, each leg has a deformable segment in the shape of a rectangular frame. The deformable segments define at least one opening where the two legs of the pin section are not overlapping, which breaks the capillary flow of solder between the legs. The amount of solder that flows into the electrical contact is selectively controlled by the selected placement of the deformable segments.

30 Claims, 6 Drawing Sheets

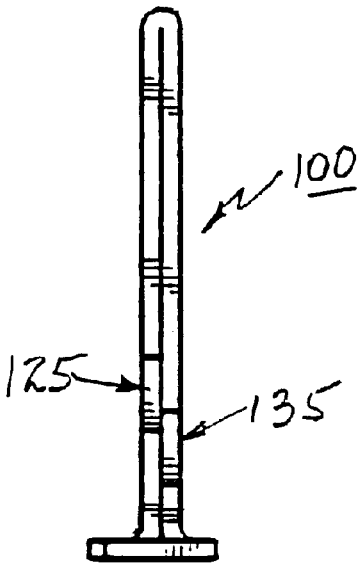
FIG. 6
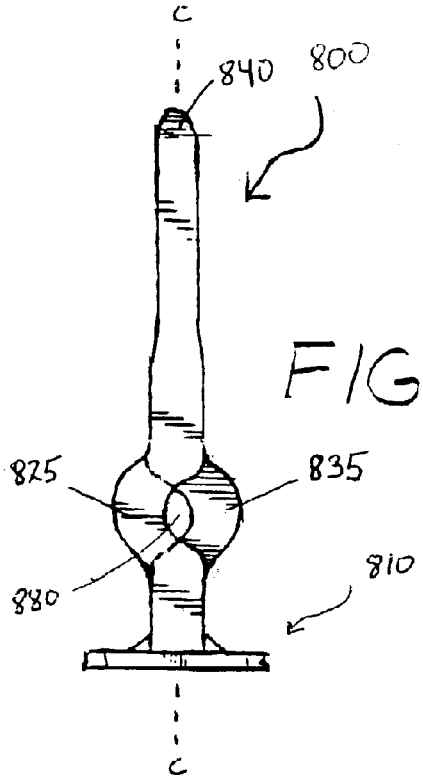
FIG. 8
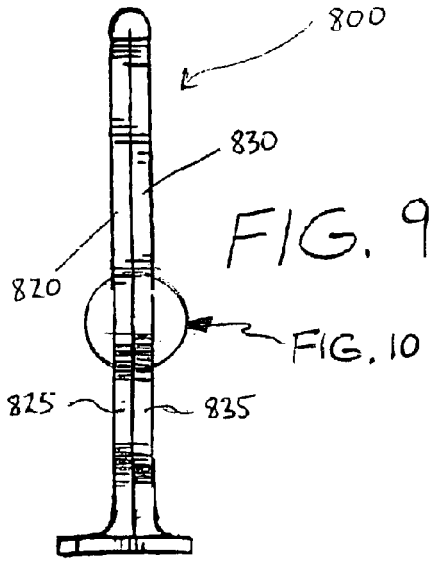
FIG. 9
FIG. 10

COMPLIANT SURFACE MOUNT ELECTRICAL CONTACTS FOR CIRCUIT BOARDS AND METHOD OF MAKING AND USING SAME

BACKGROUND OF THE INVENTION

1. Field of the Invention

This invention pertains to electrical contacts. In particular, this invention pertains to electrical contacts between and for interconnecting spaced printed circuit boards (PCBs) and/or off-board components. The electrical contact includes a deformable segment adapted to alleviate stress on the connections with slight changes in the spacing between the PCBs.

2. Description of the Related Art

Numerous electrical contact designs have been developed for connecting a printed circuit board (hereinafter "PCB") with off-board component and/or other PCBs. Representative contact designs include pins, posts, lugs, and tabs.

Surface mounting technology ("SMT") is a widely used method of securing electrical contacts to PCBs. This method includes providing an electrical contact to a "pick-and-place" machine, which picks up the electrical contact and places it at a predetermined position on a conductive pad or land on the surface of a PCB. The contact is then usually soldered to the PCB.

Once the base of the contact is secured to a PCB, the tip of the contact may be secured to a second PCB or an off-board component using a variety of techniques, including soldering, friction fitting, and clamping. For example, the tip of the contact can be fitted through an aperture or hole within a second PCB, using a through-the-hole (TTH) approach, and held within the aperture by friction and/or subsequent soldering.

In general, a contact is attached to a PCB using a rigid or inflexible bond, such as soldering. Unfortunately, these rigid, relatively small bonds are not able to resist much mechanical stress. Thus, relative movement of connected PCBs, for example, due to thermal expansion, often results in broken bonds and/or contacts.

To alleviate mechanical stress created by relative movement of the interconnected parts, electrical contacts that are deformable, compliant, and/or flexible are used as connections between PCBs and/or off-board components. For example, compliant electrical contacts are described in U.S. Pat. Nos. 4,642,889, 4,751,119, 5,317,479, 5,446,161, and 6,184,587. However, these previously described compliant electrical contacts do not have at least one deformable section that is symmetrical or otherwise balanced about the centerline thereof and, thus, are prone to uneven deformation and excessive lateral flexibility. In the case of pin-shaped contacts, the applicants are unaware of any prior example having at least one symmetrical or otherwise balanced compliant section.

Electrical contacts that are internally re-enforced by solder have also been developed, as described in U.S. Pat. No. 5,816,868 (assigned to Zierick Manufacturing Corp.). The solder wicks or flows from the conductive land on the PCB into a channel within the electrical contact. However, if too much solder is wicked away from the conductive land, the bond between the conductive land and the electrical contact is weakened. Excessive capillary flow of solder is especially troublesome for pin contacts, which often have small bases and long pin sections that wick a relatively large amount of solder from the conductive land.

BRIEF SUMMARY OF THE INVENTION

It is an object of the present invention to provide an electrical contact that is deformable, compliant, and/or flexible to alleviate mechanical stress created by relative movement of printed circuit boards and/or off-board components interconnected by the electrical contact.

It is also an object of the present invention to provide a pin-type electrical contact having at least one deformable segment along the length thereof that may alleviate stress created by relative movement of printed circuit boards and/or off-board components interconnected by the electrical contact.

It is another object of the present invention to provide such a pin-type electrical contact that has a symmetrical or otherwise balanced configuration to provide even expansion and avoid excessive lateral expansion.

It is a further object of the present invention to provide an electrical contact that stops or breaks the capillary flow of solder therein, so as to control the amount of solder that is wicked up from the conductive land into the electrical contact.

These and other objects of the present invention are accomplished by an electrical contact having a base section and a pin section, which extends from the base section at an angle substantially perpendicular to the base section. The pin section comprises two overlapping legs that are joined at a tip. Each leg has a deformable segment or segments that can expand or contract along the direction of the leg to alleviate stress created by relative movement of printed circuit boards and/or off-board components interconnected by the electrical contact. The deformable segments have members that project or extend in opposing directions relative to an axis of the pin section, so that the segments are symmetrical or otherwise balanced, which prevents the segments from twisting and/or expanding unevenly. In one embodiment of the present invention, each leg has a deformable segment having a outwardly curved or "C" shape. In another embodiment of the present invention, each leg has a deformable segment in the shape of a rectangular frame. The rectangular frames allow the electrical contact to withstand mechanical stresses normally experienced between interconnected printed circuit boards due to the possibility of deflection or deformation of the transverse portions of the rectangular frames. Moreover, due to their configurations, the deformable segments define at least one opening where the two legs of the pin section are not overlapping, which stops or breaks the capillary flow of solder between the legs when the electrical contact is soldered to a conductive land on a PCB. The amount of solder that flows into the electrical contact is selectively controlled or limited by the selected placement of the deformable segments.

BRIEF DESCRIPTION OF THE DRAWINGS

Other objects and features of the present invention may become clear from the following description taken in conjunction with the preferred embodiments thereof with reference to accompanying drawings, in which:

FIG. 6 is a side view of the electrical contact of FIG. 1;

FIG. 8 is a front plan view of an electrical contact according to a second embodiment of the present invention;

FIG. 9 is a side plan view of the electrical contact of FIG. 8;

DETAILED DESCRIPTION OF THE INVENTION

Figure 1:
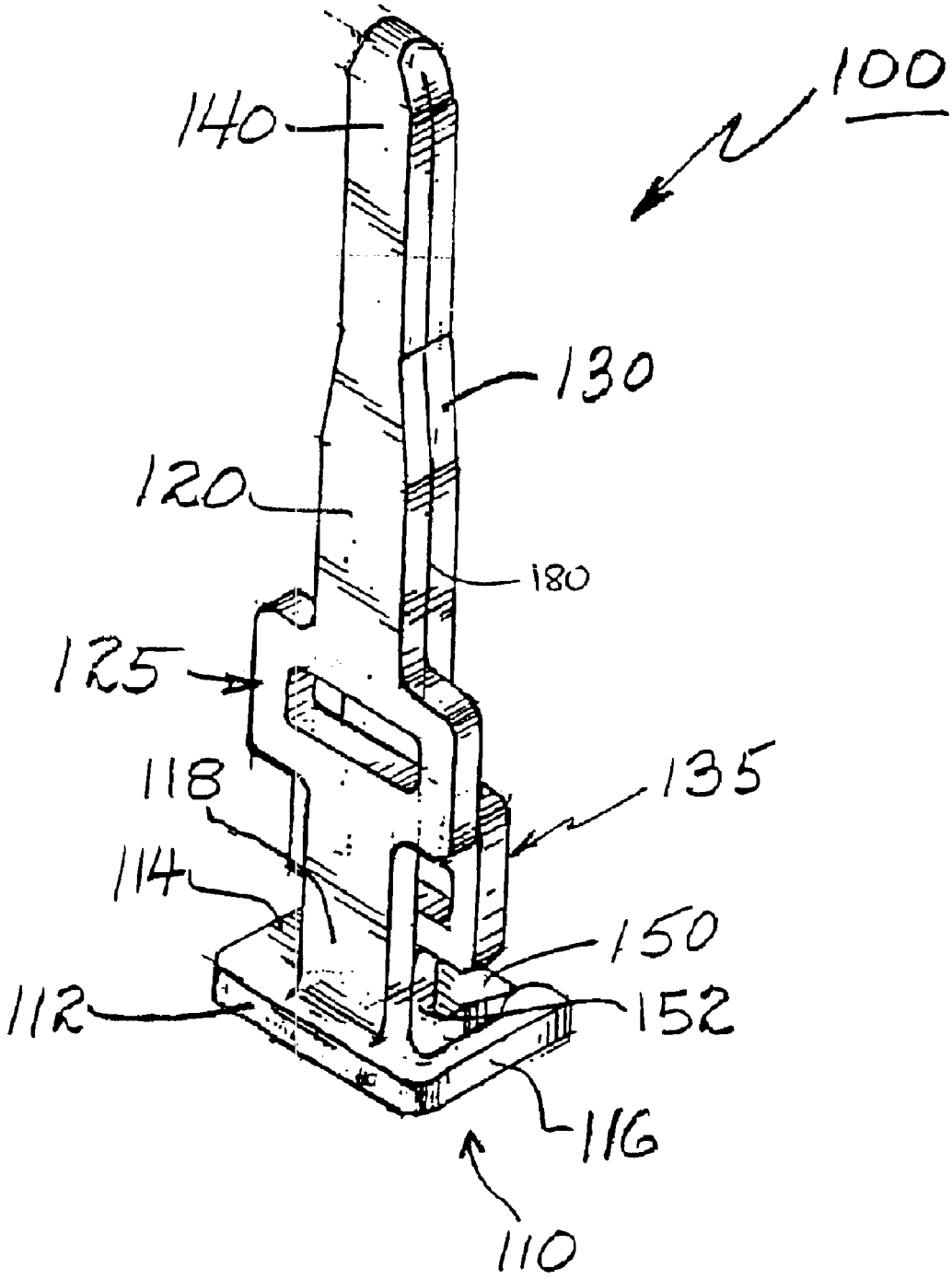
FIG. 1 is a perspective view of an electrical contact according to a first embodiment of the present invention.

Referring to the figures and, in particular, FIG. 1, there is provided an electrical connector or contact according to the present invention designated as reference numeral 100. Electrical contact 100 has a base 110, a first pin segment or leg 120, and a second pin segment or leg 130. FIG. 1 illustrates the electrical contact 100 folded into its operative shape.

Base 110 has a generally flat surface suitable for attachment to a flat conductive surface of a PCB, which is frequently referred to as a "land" or "pad" (not shown). Base 110 is generally U-shaped with a transverse segment 112 perpendicularly connected to a pair of parallel segments 114 and 116. Preferably, parallel segments 114 and 116 each have at least one inward protrusion designated, respectively, as 115 and 117 (see FIG. 2). Base 110 is preferably square in configuration, to conform to the typical shape of the lands on printed circuit boards. However, base 110 may be any desired or selected shape with any desired dimensions-and area. Transverse segment 112 may be, for example, about 0.10 inch along its longest (i.e., outer) edge, while parallel segments 114 and 116 may each be, for example, about 0.070 when measured along their respective longest (i.e., outer) sides.

Electrical contact 100 has two pin legs 120 and 130 extending substantially perpendicularly from base 110 in its operative shape of FIG. 1. First pin leg 120 has a first deformable section 125, while second pin leg 130 has a second deformable section 135. Sections or segments 125, 135 are deformable so that they can expand and contract along the central axis C of electrical contact 100, which extends in the direction of legs 120, 130. First deformable section 125 defines a first opening 170 (see FIGS. 2 and 5), while second deformable section 135 defines a second opening 175. First pin leg 120 and second pin leg 130 are connected at an intermediate portion 140, which defines the tip of electrical contact 100. Preferably, intermediate portion 140 is narrowed or necked down compared to pin legs 120 and 130.

First pin leg 120 may, for example, have a length of about 0.2 inch to about 0.245 inch. The width of first pin leg 120 is about 0.036 inch. Intermediate portion 140 is from about 0.25 inch to about 0.35 inch long and about 0.25 inch wide. Second pin leg 130, like first pin leg 120, may be about 0.2 inch to about 0.245 inch in length and about 0.036 inch in width.

Figure 2:
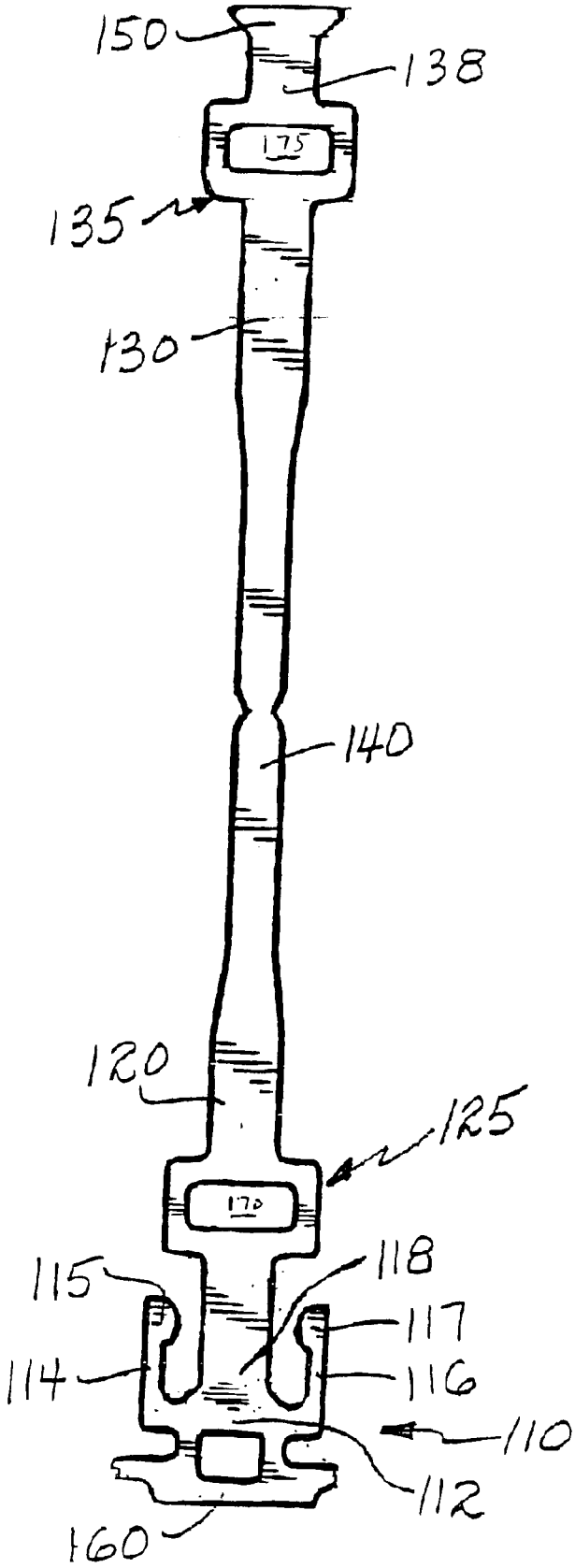
FIG. 2 is a front view of the electrical contact of FIG. 1 prior to being folded into its operable configuration.
Figure 3:
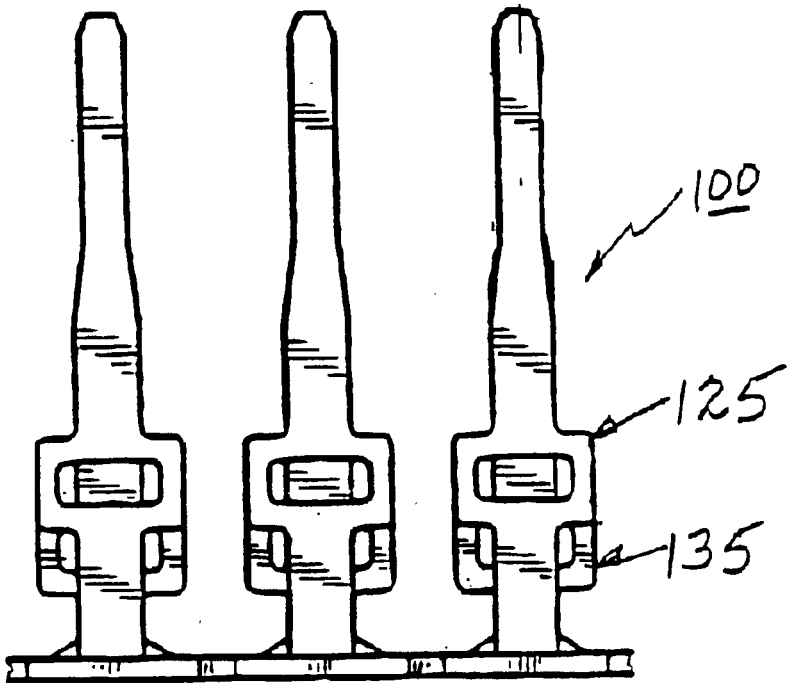
FIG. 3 is a front view of a plurality of linked electrical contacts according to a second embodiment of the present invention.
Figure 4:
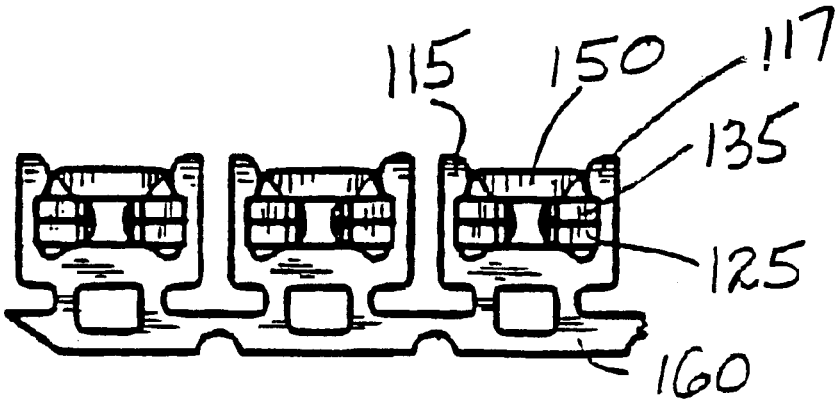
FIG. 4 is a bottom plan view of the linked electrical contacts of FIG. 3.

FIG. 2 shows contact 100 before it is folded into its operative shape. As shown in FIG. 2, before it is folded, contact 100 is a generally flat and elongated form or blank. Making contact 100 initially as a flat and elongated form allows for the economical manufacture of numerous similar electrical connectors and also allows such connectors to be produced side-by-side and connected to or supported by an detachable carrier strip 160. As shown in FIGS. 3 and 4, contact 100 may be one of a plurality of linked electrical contacts, which may be linked by detachable carrier strip 160. Further details regarding manufacturing integrated strips of electrical connectors is provided in U.S. Pat. No. 5,730,608, which is incorporated herein by reference in its entirety.

Referring again to FIG. 2, first pin leg 120 extends away from transverse segment 112 between parallel segments 114 and 116. First pin leg 120 has a first transition segment 118 integrally connected to transverse segment 112. Second pin leg 130 has a second transition segment 138 that terminates at a free end 150. Second transition segment 138 and free end 150 may be flared and also may be provided with lateral indentations (not shown). The overall dimensions of second transition section 138 and end 150 are selected so that end 150 is receivable within the space between parallel segments 114 and 116 when base portion 110 and end 150 are placed into a common plane perpendicular to pin legs 120 and 130, as described below.

Once the blank for electrical contact 100 has been made (i.e., stamped), it is folded or bent into an operative shape, as shown in FIG. 1. Transition segment 118 is bent to place base 110 in a plane substantially perpendicular to first and second pin legs 120 and 130. Intermediate portion 140 is bent to bring first and second leg portions 120 and 130 into a juxtaposed orientation. End 150 is moved into the plane of base 110 by bending a second intermediate connecting portion 252, and positioning end 150 between parallel segments 114 and 116.

Protuberances 115 and 117 hold end 150 between parallel segments 114 and 116. It will be appreciated that a combination of protuberances and indentations will provide an effective locking mechanism that prevents electrical contact 100 from deforming prior to being mounted on a PCB. Thus, electrical contact 100 maintains the integrity during picking and placement, which preferably includes the steps of severing electrical contact 100 from a strip of electrical contacts, gripping electrical contact 100 at the pick-up point, and placing the electrical contact 100 on a land on a printed circuit board.

Electrical contact 100 is made from a conductive material. Preferably, the conductive material used to make electrical contact 100 is a metal. More preferably, the conductive material used to make electrical contact 100 is a malleable metal that is shaped into a flat sheet from which electrical contact 100 may be stamped. Preferred metals for use in electrical contact 100 include brass, aluminum, tin, copper, silver, and combinations and alloys thereof. For the embodiments described in detail hereby, electrical contact 100 is stamped from a sheet of brass about 0.013 inch thick.

Figure 5:
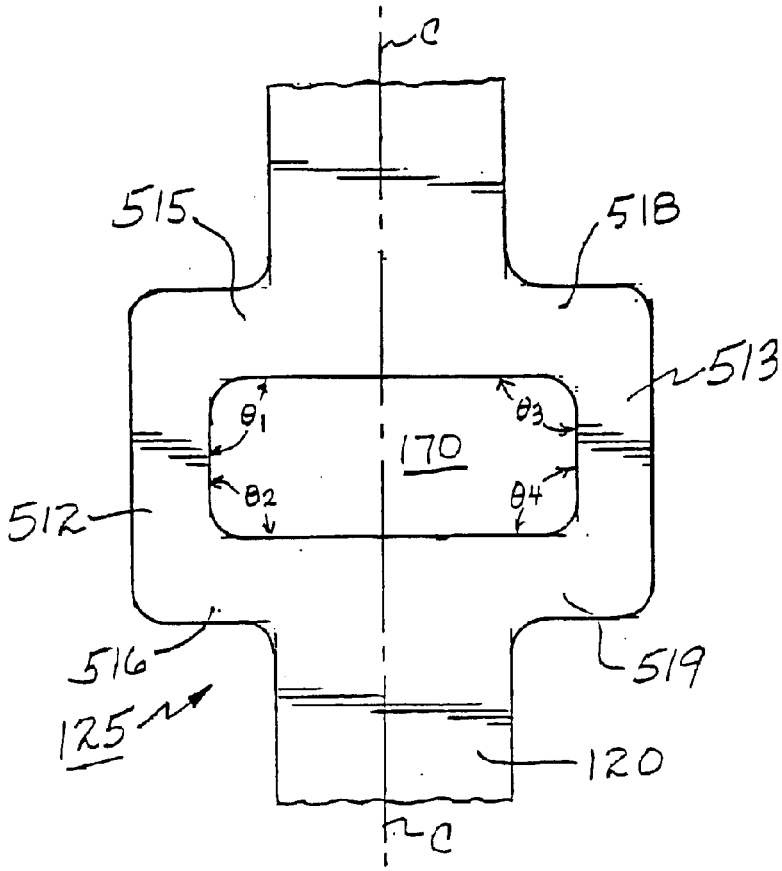
FIG. 5 is a detail view of a deformable segment or section of the electrical contact of FIG. 1.

Referring to FIG. 5, the shape of both deformable sections 125 and 135 is exemplified by reference to first deformable section 125. First deformable section 125 has a pair of spaced vertical members 512 and 513, which are parallel to centerline c and generally parallel to the axis of the pin. As used herein, length is measured along a line parallel to centerline c and width is measured along a line perpendicular to centerline c. Vertical member 512 is spaced away from centerline c by a first pair of spaced horizontal members 515, 516, which may be substantially perpendicular to centerline c. Vertical member 512 is disposed relative to horizontal members 515 and 516 at angles $\theta_1$ and $\theta_2$, respectively. Angles $\theta_1$ and $\theta_2$ are both, in the illustrated embodiment, preferably about 90°. Similarly, vertical member 513 is spaced from centerline c by a second pair of horizontal members 518 and 519 in substantially the opposite direction of vertical member 512. Vertical member 513 is disposed relative to horizontal members 518 and 519 at angles $\theta_3$ and $\theta_4$, respectively. Angles $\theta_3$ and $\theta_4$, like angles $\theta_1$ and $\theta_2$, may both be about 90°.

The shape of deformable segment or section 125 has the overall appearance of a rectangular frame defining opening 170. Moreover, the shape of deformable section 125 is symmetrical about centerline c. The overall rectangular structure of deformable section 125 resists uneven expansion and/or twisting. In other words, deformable section 125 responds to mechanical stresses along directions parallel to the centerline c without moving substantially out of its original plane. Expansion of deformable section 125 primarily results from the deflection or deformation of the transverse or horizontal members 515, 516, 518, 519.

Vertical members 512 and 513 may both be, for example, about 0.050 inch in length and about 0.013 inch in width. Horizontal members 515, 516, 518, and 519 may all be, for example, about 0.027 inch wide and 0.013 inch long. The orientation of vertical members 512, 513 with horizontal members 515, 516, 518, and 519 defines a space 170 that may be about 0.024 long and about 0.064 wide.

As shown in FIGS. 1, 3, 6, and 11 deformable sections 125 and 135 are vertically offset from one another when electrical contact is folded into an operable shape. The lower transverse portion of first deformable section 125 overlaps the upper portion of second deformable section 135. To achieve this overlap, first deformable section 125 is spaced about 0.055 inch from base 110, while second deformable section 135 is disposed about 0.09 inch from base 110. The overlapping of deformable sections 125 and 135 increases the ability of electrical contact 100 to resist being twisted.

Figure 7:
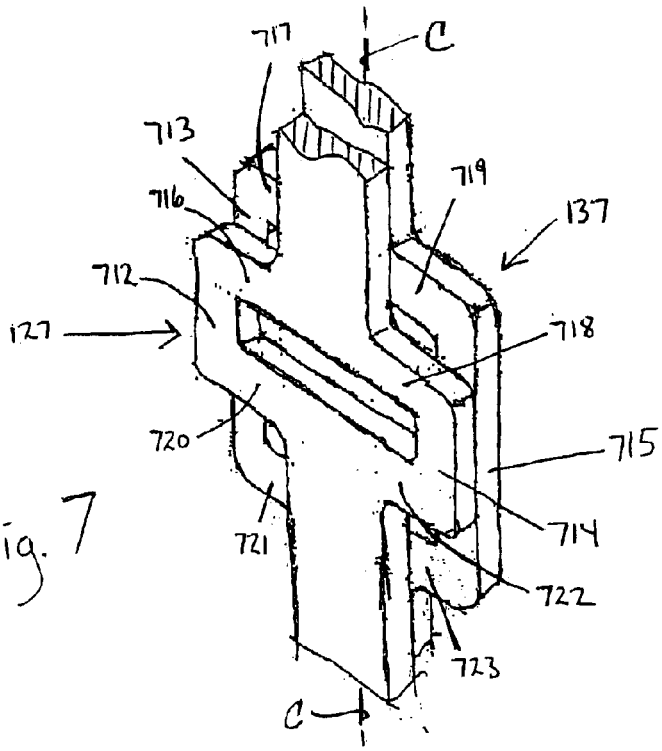
FIG. 7 is a detail view of an alternative deformable segment of the electrical contact of FIG. 1.

Referring to FIG. 7, an alternative deformable segment is illustrated having deformable sections 127 and 137. Deformable sections 127 and 137 are similar to deformable sections 125 and 135, insofar as deformable sections 127 and 137 are both generally rectilinear or rectangular, symmetrical about centerline c, and define openings therein, thus being adapted to deflect or deform in response to mechanical stresses thereon. However, the vertical members 713 and 715 of deformable section 137 are longer than vertical members 712 and 714 of deformable section 127. Thus, deformable section 137 is larger than deformable section 127. Significantly, when deformable sections 127 and 137 are oriented in their operable position, the horizontal members 717 and 719 of deformable section 137 are above the horizontal members 716 and 718 of deformable section 127, and the horizontal members 721 and 723 of deformable section 137 are below the horizontal members 720 and 722 of deformable section 127. Thus, the vertical members of deformable sections 127 and 137 are not vertically offset from one another, since the full lengths of vertical members 712 and 714 are completely overlapped by respective portions of vertical members 713 and 715. Nonetheless, since the horizontal members of deformable sections 127 and 137 are vertically offset from one another, the coordination of deformable sections 127 and 137 will offer similar resistance to mechanical stresses as the coordination of deformable sections 125 and 135.

Referring to FIGS. 8 and 9, a second embodiment of an electrical contact according to the present invention is illustrated thereby and indicated generally as 800. Like electrical contact 100, electrical contact 800 has a base 810, a first pin segment or leg 820, and a second pin segment or leg 830.

First and second pin legs 820 and 830 extend vertically from base 810 at an angle substantially perpendicular to base 810. First pin leg 820 has a first deformable section 825, while second pin leg 830 has a second deformable section 835. First pin leg 820 and second pin leg 830 are connected at an intermediate portion 840, which defines the tip of electrical contact 800. Preferably, intermediate portion 840 is narrowed or necked down compared to pin legs 820 and 830.

The shape of both deformable sections 825 and 835 is exemplified by reference specifically to first deformable section 825. First deformable section 825 is curved out of alignment with first pin leg 820. Deformable section 825 will normally have a smoothly curved shape, such as a "C." When compressed or stretched along centerline c, deformable section 825 will have a modified "C" shape or other shape depending on the degree of compression or stretching.

As illustrated in FIGS. 8 and 9, deformable sections 825 and 835 project outwardly or away from centerline c in opposing directions. Deformable sections 825 and 835 are also substantially coextensive along centerline c, meaning that sections 825 and 835 are not vertically offset from one another, which is unlike deformable sections 125 and 135. Together, deformable sections 825 and 835 will form a generally symmetrical or otherwise substantially balanced shape, such as an oval, circle, or rectangle having an opening 870. The symmetrical shape formed by the opposing deformable sections 825 and 835 resists uneven mechanical stresses. In other words, deformable sections 825 and 835 respond evenly to mechanical stresses substantially without moving out of their original plane.

Figure 10:
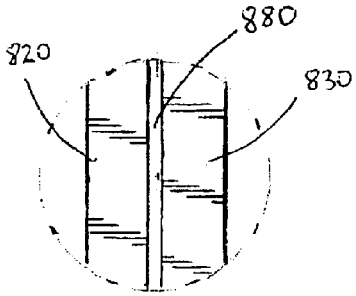
FIG. 10 is a magnified side view of the electrical contact of FIG. 9 showing the channel between the two legs of the pin section.

Referring to FIG. 1, when first pin leg 120 and second pin leg 130 are folded into their operative orientation, first pin leg 120 and second pin leg 130 are slightly spaced apart from one another, thereby forming a gap or channel 180 therebetween. Simiarly, referring to FIG. 10, when first pin leg 820 and second pin leg 830 are folded into their operative orientation, first pin leg 820 and second pin leg 830 are slightly spaced apart from one another, thereby forming a gap or channel 880 therebetween. Channels 180 and 880 have dimensions that will create a flow of solder into electrical contact 100 and 800, respectively, by capillary action, which provides numerous benefits. For example, an electrical contact with an amount of solder as internal reinforcement can generally withstand larger mechanical stresses (e.g., compression, expansion, and shear) than terminals without such reinforcement.

The dimensions of channel 180, 880 will depend on numerous factors, including the nature of the solder paste, the cleanliness and size of the land or pad, and the orientation of the board during installation. Channel 180, 880 may be about 0.0015 inch wide. Further details of capillary flow in channel 180, 880 is provided in U.S. Pat. No. 5,816,868, which is incorporated into the description of the present invention in its entirety.

Referring again to FIGS. 1, 2, and 5, legs 120 and 130 are provided with openings 170 and 175, which are defined by deformable sections 125 and 135. These openings 170, 175 are adapted so as to break or stop capillary flow of solder within channel 180. The amount of solder that flows into channel 180 is primarily controlled by the placement of the lower of the two openings 170 and 175. More solder will flow into channel 180 when the lower opening is located farther away from base 110. Conversely, less solder will flow into channel 180 when the lower opening is located nearer to base 110. In the presently described first embodiment of electrical contact 100, opening 170 is the lower opening and may begin, for example, about 0.063 inch from base 110. Thus, solder will flow about 0.063 inch into channel 180 before being stopped by opening 170.

By controlling the amount of solder that flows into channel 180, the advantages of the capillary flow can be achieved without risking the penalties of excessive wicking of the solder away from the conductive land, such as a weakened bond between the electrical contact and the PCB. Moreover, stopping the flow of solder before the solder reaches the tip of electrical contact 100 avoids the risk that the solder will undesirably or prematurely bond to the through-hole of a second or upper PCB.

The second embodiment of the present invention, as described in reference to FIGS. 8 and 9, has an opening 870 defined by deformable sections 825 and 835. Opening 870 has similar effects and advantages as the openings 170, 175.

As stated above, an additional benefit of controlling the capillary action is increased solder joint integrity between base 110 and the conductive land oh the PCB. Since part of the melted solder is pulled into channel 180, the remaining solder between the terminal and the PCB solder pad is relatively thinner than the solder thickness of a conventional solder joint. A thin layer of solder is desirable, since the solder alloy has a low yield strength and, thus, a larger amount of solder withstands less mechanical stress. The integrity of the solder joint is very important because there is no other mechanical means to fasten the terminal to the PCB board.

Figure 11:
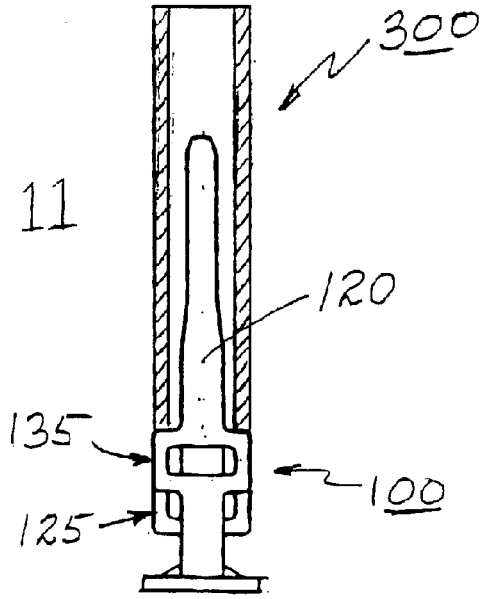
FIG. 11 is a cross-sectional view of a vacuum nozzle of a pick-and-place machine showing the electrical contact of FIG. 1 inserted therein.

The preferred method of installing electrical contact 100 on a PCB employs a pick-and-place machine, several types of which are well known in the art. Commonly, pick-and-place machines use vacuum suction to pick up the selected electrical contact and place it on the PCB. Referring to FIG. 11, vacuum suction can be applied to electrical contact 100 through a tube 300 that is sized to fit over at least a portion of electrical contact 100. Preferably, tube 300 is sized to fit over pin legs 120 and 130, but not fit over deformable sections 125 and 135. In effect, deformable sections 125 and 135 create a shelf or stop for tube 300. If electrical contact 100 is linked to other electrical contact via a detachable arm 160, the pick-and-place machine must be adapted to separate electrical contact 100 from detachable arm 160 before electrical contact 100 is picked up by vacuum tube 300. Further details of pick-and-place machines are provided in U.S. Pat. Nos. 5,449,265 and 5,605,430, both of which are incorporated herein by reference in their entirety.

Figure 12:
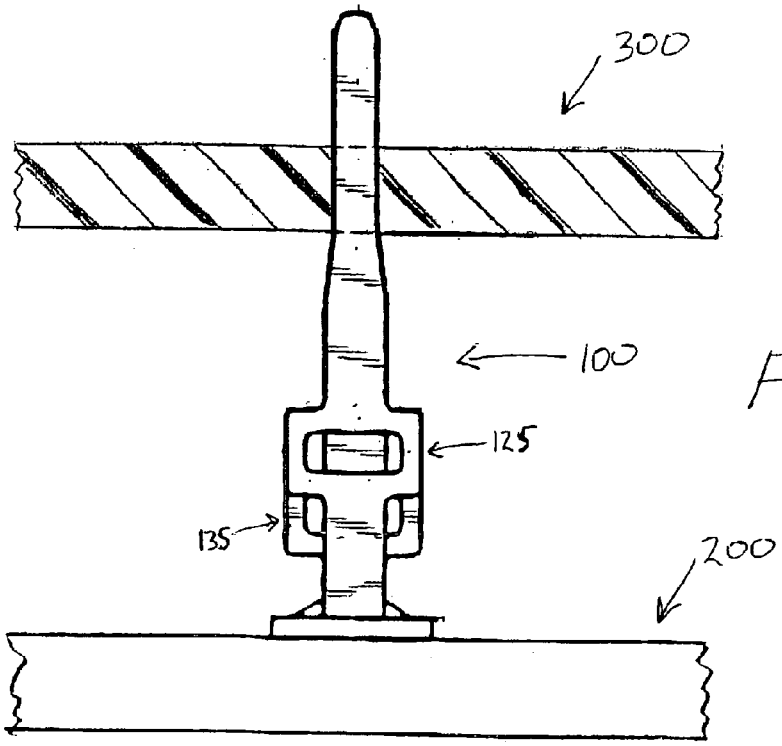
FIG. 12 is a front view of the electrical contact of FIG. 1 connected to a first or lower PCB and a second or upper PCB or off-board component.

Referring to FIGS. 5 and 12, electrical contact 100 is adapted to maintain contact between a PCB 200 and another PCB or off-board component (indicated generally as reference number 300) by allowing relative movement between the interconnected boards without breaking the solder joints therebetween. The ability of electrical contact 100 to withstand such relative movement is created by deformable sections 125 and 135. When two PCBs that are interconnected by electrical contact 100 move away from one another, deformable sections 125 and 135 change shape by being stretched to lengthen electrical contact 100 by increasing angles $\theta_1$, $\theta_2$, $\theta_3$, and $\theta_4$ between the respective horizontal and vertical segments of deformable section 125 and 135, which has the effect of bringing the originally horizontal segments into closer vertical alignment with the vertical segments and also reducing the space between the original vertical segments. Furthermore, when two PCBs that are interconnected by electrical contact 100 move closer to one another, deformable sections 125 and 135 may change shape to shorten electrical contact 100 by, for example, collapsing their overall rectangular shape. Moreover, when two PCBs that are interconnected by electrical contact 100 move closer to one another, deformable sections 125 and 135 may change shape to change the distance between the tip of electrical contact 100 relative to base 110.

The present invention having been described with particular reference to the preferred forms thereof, it will be obvious that various changes and modifications may be made herein without departing from the spirit and scope of the invention as defined in the appended claims.

We claim:

1. An electrical contact comprising:

a substantially rigid base section adapted for attachment to a conductive land on a first printed circuit board; and a substantially rigid pin section extending from the base section along a centerline substantially normal to the base section, the pin section having two leg segments adjacent to one another and interconnected by a folded intermediate section, the folded intermediate section forming a tip of the pin section that is adapted for connection with a second printed circuit board, the two leg segment having deformable sections therein that project outwardly away from the centerline, the deformable sections in combination forming a substantially symmetrical shape about the centerline, wherein the electrical contact is adapted to deform substantially vertically and substantially evenly while resisting lateral expansion or twisting.

2. The electrical contact of claim 1, wherein each of the deformable sections comprises at least one curved member.

3. The electrical contact of claim 1, wherein each of the deformable sections comprises at least two substantially linear members disposed at an angle to one another.

4. The electrical contact of claim 1, wherein the deformable sections are at least partially offset relative to one another.

5. The electrical contact of claim 1, wherein each of the deformable sections defines a substantially rectangular shape formed by two vertical members each spaced apart from the centerline by an upper horizontal member and a lower horizontal member.

6. The electrical contact of claim 5, wherein at least two selected horizontal members of the deformable sections are vertically offset relative to one another.

7. The electrical contact of claim 1, wherein each of the deformable sections defines a substantially rectangular shape, the substantially rectangular shape formed by two vertical members each spaced apart from the centerline by an upper horizontal member and a lower horizontal member, and wherein the first and second deformable sections are at least partially offset relative to one another, whereby the lower horizontal segments of the first deformable section are co-extensive with the upper horizontal segments of the second deformable section.

8. The electrical contact of claim 1, wherein each of the deformable sections defines a substantially rectangular shape, the substantially rectangular shape formed by two vertical members each spaced apart from the centerline by an upper horizontal member and a lower horizontal member, and wherein the vertical members of the first deformable section are longer than the vertical members of the second deformable section, whereby the lower horizontal segments of the first deformable section are below the lower horizontal segments of the second deformable section, and whereby the upper horizontal segments of the first deformable section are above the upper horizontal segments of the second deformable section.

9. An electrical contact comprising:

a substantially rigid base section adapted for attachment to a conductive land on a first printed circuit board;

a substantially rigid pin section extending from the base section along a centerline substantially normal to the base section, the pin section having two leg segments adjacent to one another and interconnected by a folded intermediate section, the folded intermediate section forming a tip of the pin section that is adapted for connection with a second printed circuit board, each of the two leg segment having an opening therethrough at a position above the base section and below the tip, the two openings forming a hole through the pin section; and a channel through the base section and between the two leg segments that is parallel to the centerline and adapted to allow an amount of a soldering material from the conductive land to flow via capillary action through the base section and between the two leg segments, the channel being intersected by the hole, wherein the capillary action of the soldering material in the channel is broken by the hole, thereby preventing the solding material from flowing past the hole and controlling the amount of soldering material that flows from the conductive land.

10. The electrical contact of claim 9, wherein the two openings are each defined by a deformable section.

11. The electrical contact of claim 9, wherein the two openings are each defined by a deformable section, and wherein the deformable sections each comprise at least one curved member that projects outwardly away from the centerline.

12. The electrical contact of claim 9, wherein the two openings are each defined by a deformable section, and wherein the deformable sections each comprise at least two substantially linear members that projects outwardly of the centerline and are disposed at an angle to one another.

13. The electrical contact of claim 9, wherein the two openings are each defined by a deformable section that is substantially rectangular with vertical members each spaced apart from the centerline by an upper horizontal member and a lower horizontal member.

14. The electrical contact of claim 9, wherein the two openings are each defined by a deformable section, and wherein the deformable sections are substantially symmetrical about the centerline of the pin section, whereby the hole is substantially symmetrical about the centerline of the pin section.

15. The electrical contact of claim 9, wherein the two openings are at least partially offset relative to one another.

16. The electrical contact of claim 9, wherein the two openings are differently shaped, whereby one of the openings is larger than the other.

17. The electrical contact of claim 9, wherein the two openings are each defined by a deformable section that defines a substantially rectangular shape, the substantially rectangular shape being formed by two vertical members each spaced apart from the centerline by an upper horizontal member and a lower horizontal member, and wherein the first and second deformable sections are at least partially offset relative to one another, whereby the lower horizontal segments of the first deformable section are co-extensive with the upper horizontal segments of the second deformable section.

18. The electrical contact of claim 9, wherein the two openings are each defined by a deformable section that defines a substantially rectangular shape, the substantially rectangular shape being formed by two vertical members each spaced apart from the centerline by an upper horizontal member and a lower horizontal member, and wherein the vertical members of the first deformable section are longer than the vertical members of the second deformable section, whereby the lower horizontal segments of the first deformable section are below the lower horizontal segments of the second deformable section, and whereby the upper horizontal segments of the first deformable section are above the upper horizontal segments of the second deformable section.

19. An electrical contact comprising:

a substantially rigid base section adapted for attachment to a conductive land on a first printed circuit board;

a substantially rigid pin section extending from the base section along a centerline substantially normal to the base section, the pin section having two leg segments adjacent to one another and interconnected by a folded intermediate section, the folded intermediate section forming a tip of the pin section that is adapted for connection with a second printed circuit board, each leg segment having a deformable section therein that projects outwardly away from the centerline, the deformable sections in combination being substantially symmetrical about that centerline and defining a hole through the pin section; and a channel through the base section and between the two leg segments that is parallel to the centerline and adapted to allow an amount of a soldering material from the conductive land to flow via capillary action through the base section and between the two leg segments, the channel being intersected by the hole, wherein the deformable section is adapted to deform substantially vertically and substantially evenly while resisting lateral expansion or twisting, and wherein the capillary action of the soldering material in the channel is broken by the hole, thereby preventing the solding material from flowing past the hole and controlling the amount of soldering material that flows from the conductive land.

20. The electrical contact of claim 19, wherein the deformable sections each comprise at least one curved member.

21. The electrical contact of claim 19, wherein the deformable sections each comprise at least two substantially linear members disposed at an angle to one another.

22. The electrical contact of claim 19, wherein the deformable sections each define a substantially rectangular shape.

23. The electrical contact of claim 19, wherein the deformable sections are at least partially offset relative to one another.

24. The electrical contact of claim 19, wherein the deformable sections are at least partially offset relative to one another.

25. The electrical contact of claim 24, wherein at least two selected horizontal members of the deformable sections are vertically offset relative to one another.

26. The electrical contact of claim 19, wherein the deformable sections each respectively defines a substantially rectangular shape, the substantially rectangular shape formed by two vertical members each spaced, apart from the centerline by an upper horizontal member and a lower horizontal member, and wherein the first and second deformable sections are at least partially offset relative to one another, whereby the lower horizontal segments of the first deformable section are co-extensive with the upper horizontal segments of the second deformable section.

27. The electrical contact of claim 19, wherein the deformable sections each respectively defines a substantially rectangular shape, the substantially rectangular shape formed by two vertical members each spaced apart from the centerline by an upper horizontal member and a lower horizontal member, and wherein the vertical members of the first deformable section are longer than the vertical members of the second deformable section, whereby the lower horizontal segments of the first deformable section are below the lower horizontal segments of the second deformable section, and whereby the upper horizontal segments of the first deformable section are above the upper horizontal segments of the second deformable section.

28. A method of making an electrical contact comprising the step of:

(1) forming a metal blank with:

(a) a substantially rigid base section adapted for attachment to a conductive land on a first printed circuit board, (b) a substantially rigid pin section extending from the base section along a centerline and having a first leg segment, a second leg segment, and a foldable intermediate segment between the first and second leg segments, the first and second leg segments each having a deformable section therein that has at least one member projecting outwardly away from the centerline; and (2) folding the metal blank into an operable shape wherein the pin section extends at an angle substantially perpendicular to the base section, the deformable sections are oriented substantially symmetrically about the centerline and define an opening through the pin section, and there is a channel between the first and second leg segments that is adapted to allow an amount of a soldering material from the conductive land to flow via capillary action through the base section and into the pin section, the channel being intersected by the opening.

29. A method of interconnecting a first printed circuit board and a second printed circuit board comprising the steps of:

(1) providing an electrical contact including:

(a) a substantially rigid base section adapted for attachment to a conductive land on a first printed circuit board;

(b) a substantially rigid pin section extending from the base section along a centerline substantially normal to the base section, the pin section having two leg segments adjacent to one another and interconnected by a folded intermediate section, the folded intermediate section forming the tip of the pin section that is adapted for connection with a second printed circuit board, each leg segment having a deformable section therein having at least one member that projects outwardly away from the centerline, the deformable sections in combination being substantially symmetrical about that centerline and defining a hole through the pin section; and (c) a channel through the base section and between the two leg segments that is parallel to the centerline and adapted to allow an amount of a soldering material from the conductive land to flow via capillary action through the base section and between the two leg segments, the channel being intersected by the hole, wherein the deformable section is adapted to deform substantially vertically and substantially evenly while resisting lateral expansion or twisting, and wherein the capillary action of the soldering material is broken by the hole, thereby preventing the solding material from flowing past the hole and controlling the amount of soldering material that flows from the conductive land; and (2) attaching the base section to the first printed circuit board; and (3) attaching the pin section to the second printed circuit board.

30. The method of claim 29, wherein the electrical contact is surface mounted to the first printed circuit board.

* * * * *